US008926485B2

(12) United States Patent
Diehr et al.

(10) Patent No.: US 8,926,485 B2
(45) Date of Patent: Jan. 6, 2015

(54) FOLDER GLUER AND METHOD FOR CONTROLLING INDIVIDUAL PROCESSING STATIONS INSIDE A FOLDER GLUER

(75) Inventors: Wolfgang Diehr, Grevenbroich (DE); Frank Schmid, Krefeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 696 days.

(21) Appl. No.: 13/222,095

(22) Filed: Aug. 31, 2011

(65) Prior Publication Data

US 2012/0053031 A1 Mar. 1, 2012

(30) Foreign Application Priority Data

| | | |
|---|---|---|
| Aug. 31, 2010 | (DE) | 10 2010 036 012 |
| Aug. 31, 2010 | (DE) | 10 2010 036 014 |
| Mar. 2, 2011 | (DE) | 10 2011 012 807 |

(51) Int. Cl.

| | |
|---|---|
| ***B31B 49/02*** | (2006.01) |
| ***B31B 1/62*** | (2006.01) |
| ***B41J 3/32*** | (2006.01) |

(52) U.S. Cl.

CPC ..... *B41J 3/32* (2013.01); *B31B 2201/88* (2013.01); *B31B 2203/00* (2013.01)

USPC ..... 493/16; 493/128; 493/55

(58) Field of Classification Search

CPC ..... B41J 3/32; B31B 2201/88; B31B 2203/00

USPC ..... 493/16, 128, 17, 55, 8

See application file for complete search history.

(56) References Cited

U.S. PATENT DOCUMENTS

| | | | | |
|---|---|---|---|---|
| 4,286,149 | A | 8/1981 | Ben-Nathan et al. | |
| 5,222,729 | A | 6/1993 | Wallschkowski | |
| 5,598,006 | A | 1/1997 | Stringa | |
| 5,974,683 | A | 11/1999 | Shibata | |
| 6,419,079 | B1 | 7/2002 | Diehr | |
| 7,556,444 | B2 * | 7/2009 | Kurashina et al. | 400/109.1 |
| 7,604,174 | B2 | 10/2009 | Gerst, III et al. | |

(Continued)

FOREIGN PATENT DOCUMENTS

| | | | |
|---|---|---|---|
| DE | 196 04 856 | A1 | 8/1997 |
| DE | 198 21 875 | A1 | 11/1999 |

(Continued)

OTHER PUBLICATIONS

German Patent and Trademark Office Citation of Publications, Dated May 19, 2011.

(Continued)

*Primary Examiner* — Hemant M Desai

(74) *Attorney, Agent, or Firm* — Laurence A. Greenberg; Werner H. Stemer; Ralph E. Locher

(57) ABSTRACT

A folder gluer or folding-box gluer includes a Braille embossing monitoring device that evaluates Braille embossments at least with regard to position, height and volume. Data are passed on to a control device that controls a distance between a male die and a female die and/or a position of the male die and the female die relative to a folding box on a basis of signals being supplied. A method for controlling individual processing stations inside a folder gluer or folding-box gluer during the manufacture of folding boxes, is also provided.

10 Claims, 6 Drawing Sheets

(56) References Cited

U.S. PATENT DOCUMENTS

| | | | | |
|---|---|---|---|---|
| 7,794,379 | B2 * | 9/2010 | Diehr et al. | 493/55 |
| 8,506,464 | B2 * | 8/2013 | Diehr et al. | 493/58 |
| 2006/0222429 | A1 * | 10/2006 | Kurashina | 400/76 |
| 2008/0108489 | A1 * | 5/2008 | Diehr et al. | 493/55 |
| 2010/0053287 | A1 | 3/2010 | Belelie et al. | |
| 2010/0110173 | A1 * | 5/2010 | Kagawa | 348/88 |
| 2010/0180781 | A1 * | 7/2010 | Foppapedretti | 101/28 |
| 2010/0236431 | A1 * | 9/2010 | Roberts et al. | 101/23 |

FOREIGN PATENT DOCUMENTS

| | | | | |
|---|---|---|---|---|
| DE | 198 28 819 | A1 | 12/1999 | |
| DE | 697 08 534 | T2 | 7/2002 | |
| DE | 10 2004 022 344 | A1 | 12/2005 | |
| DE | 10 2005 050 040 | A1 | 5/2006 | |
| DE | 20 2008 003 135 | U1 | 4/2008 | |
| DE | 60 2004 011 979 | T2 | 2/2009 | |
| EP | 0 028 056 | A1 | 5/1981 | |
| EP | 1 591 230 | A1 | 11/2005 | |
| EP | 1788510 | A1 | 5/2007 | |
| EP | 1 920 911 | A1 | 5/2008 | |
| EP | 2058115 | A2 | 5/2009 | |
| EP | 2161137 | A1 | 3/2010 | |
| WO | 91/14997 | A1 | 10/1991 | |
| WO | WO 2008114018 | A3 * | 12/2008 | |
| WO | WO 2009016659 | A1 * | 2/2009 | B41J 3/38 |

OTHER PUBLICATIONS

German Patent and Trademark Office Search Report, Dated June 3, 2011.

German Patent and Trademark Office Citation of Publications, Dated April 19, 2011.

* cited by examiner

FOLDER GLUER AND METHOD FOR CONTROLLING INDIVIDUAL PROCESSING STATIONS INSIDE A FOLDER GLUER

CROSS-REFERENCE TO RELATED APPLICATION

This application claims the priority, under 35 U.S.C. §119, of German Patent Applications DE 10 2010 036 014.7, filed Aug. 31, 2010, DE 10 2010 036 012.0, filed Aug. 31, 2010 and DE 10 2011 012 807.7, filed Mar. 2, 2011; the prior applications are herewith incorporated by reference in their entirety.

BACKGROUND OF THE INVENTION

Field of the Invention

The invention relates to a folder gluer or folding-box gluer having at least one monitoring device for checking qualitative aspects of flat, sheet-like material made from paper, cardboard or the like during folding-box manufacture, in which the at least one monitoring device is constructed as an optical Braille embossing monitoring device that evaluates the Braille embossments or Braille dots at least with regard to position, height and volume. The invention also relates to a method for controlling a Braille embossing module in individual processing stations inside a folder gluer or folding-box gluer during the manufacture of folding boxes.

When producing high-value printed products, for example folding boxes for the pharmaceutical and cosmetic industry, high demands are placed on the quality and on the printed sheets, as well as on the cut-out folding-box blanks up to and including the ready-folded and glued folding boxes and, in addition to the pharmaceutical industry, high demands are placed on the exactitude of the imprints as well as of the Braille embossments of the manufactured folding boxes. As early as during the overall production workflow during manufacture, that necessitates defect monitoring of, for example:

- Paper defects such as, for example, box inserts,
- Foreign particles, for example dust, undesired foil remains, waste cuttings, stickers and glue remains,
- Color deviations or paint defects (missing paint, paint on undesired surfaces, paint splashes), blurred contours,
- Register offset,
- Text defects,
- Defects in hot foil embossing (holes in the surface, frayed edges, missing surfaces),
- Scratches and mechanical defects in the sheet surface (in the unprinted cardboard, in the printed image, in the paint or in the foil),
- Matrix codes,
- Missing window or other applications from preceding production steps,
- Material purity of the copies,
- Agreement between barcodes and/or Braille embossments and the legible contents, and
- Exactitude of the Braille embossments with reference to position, volume and height of the Braille dots, etc.

In order to manufacture folding boxes, the sheets are firstly printed in wide-web fashion in a printing machine. A plurality of copies of the folding boxes to be manufactured are respectively imprinted on the sheets and are then cut out in a blanking press. The cut-out folding-box blanks are subsequently fed to a folder gluer and processed in that case into folding boxes.

Folder gluers for manufacturing folding boxes from folding-box blanks are known to have at least the following modules as processing stations:

- a feeder that sequentially removes blanks which are to be processed at high speed from a stack and feeds the blanks individually to a subsequent first processing station,
- an application unit for adhesive, usually glue, that applies an adhesive strip to the folding flaps to be glued, and
- a folding station in which the blank parts provided with an adhesive strip are doubled over by 180°, that is to say folded, in order to manufacture a glued joint.

A so-called transfer station, in which the boxes can be counted, marked and ejected, if damaged, is usually disposed subsequent to the folding station.

The transfer station is followed by a pressing station, at the start of which there is formed an imbricated stream of folded blanks which is held for some time under pressure in the pressing station so that the two blanks are joined at the glued seam.

The individual processing stations have driven conveying elements for transporting the folding-box blanks. Those elements respectively include, for example, an upper and lower conveyer belt disposed on the side of the machine, with the lower conveyer belt being guided in a roller sidepiece or cheek, and the upper conveyer belt being guided in a rolling rail. The conveyer belts are disposed in such a way that they can be adjusted transversely, and can therefore be set to the respective folding-box blank format. The blanks are transported with the printed side downward between the upper and lower conveyer belts. Such a folder gluer is known from German Published Patent Application DE 10 2004 022 344 A1.

It is sensible in the context of series production to monitor the possible defects inline in order to ensure that the products being manufactured satisfy quality requirements.

It is known for that purpose to carry out monitoring with the aid of line cameras that are disposed above the sheet transport plane.

Since the blanks in the folder gluer are transported by the transport device with the printed side downward through the individual processing stations, it is sensible to place the line cameras below the blank transport plane. Since the camera is intended to take a picture over the entire printed blank width, the lower continuous conveying elements have a disturbing effect.

German Published Patent Application DE 10 2005 050 040 A1 discloses a device with which it is possible to inspect the rear side of a sheet lying on a conveyer belt. The camera is fitted in a gap in the transport band below the sheet transport plane. To that end, the transport band is laid over deflecting rollers in a loop. It is a disadvantage of that device that the installation space for the camera is restricted and the manufacturing costs of the transport device are very high.

European Published Patent Application EP 2 039 513, corresponding to U.S. Patent Application Publication No. US 2009/0079971 A1 discloses a method and a device in which information relating to surface defects is gathered during the course of processing and is then used to classify the finished substrate. It is then possible, on the basis of that classification, to decide whether the substrate satisfies the quality requirements or is to be ejected.

Monitoring raised structures such as, for example, Braille embossments, is possible only to a limited extent by using the known methods.

A device for analyzing the topography of a surface of a substrate is now known from International Publication No.

WO 2011/009566 A1. The device likewise has a camera and a light source that are aligned at defined angles to the substrate. The one-dimensional image recorded by the camera is stored in a memory. A three-dimensional image is produced through the use of the known triangulation method.

A contactless detection and analysis of Braille embossments through the use of the light section triangulation method is likewise disclosed in European Published Patent Application EP 1 788 510. The described method can be used to check both the position and the height of the elevations.

Defective sheets are ejected in the case of the known devices.

SUMMARY OF THE INVENTION

It is accordingly an object of the invention to provide a folder gluer or folding-box gluer and a method for controlling individual processing stations inside a folder gluer or folding-box gluer, which overcome the hereinafore-mentioned disadvantages of the heretofore-known devices and methods of this general type and with the aid of which it is possible to reduce the number of defectively embossed sheets.

With the foregoing and other objects in view there is provided, in accordance with the invention, a folder gluer, comprising at least one monitoring device for checking qualitative aspects during folding-box manufacture. This at least one monitoring device is constructed as an optical Braille embossing monitoring device and evaluates the Braille embossments at least with regard to position, height and volume. The Braille embossing monitoring device is disposed downstream of a Braille embossing device inside the folder gluer. The Braille embossing device has a male die and a female die. The Braille embossing monitoring device is connected to a control device that controls the distance between, and/or the position of the male die and the female die relative to one another and/or the position of the male die and the female die relative to the folding box, on the basis of signals supplied by the Braille embossing monitoring device.

This embodiment has the advantage that the Braille embossments can also be analyzed topographically and the results can be used immediately for further production, something which minimizes the number of Braille dots outside the tolerance and thus minimizes scrap. As a function of the measurement result:

- the embossment is corrected (regarding the height of the Braille dots and/or the position of the Braille dots relative to the box edge);
- the deviation from the desired values is displayed on an operator display;
- or simply only the accuracy of the actual values is confirmed on an operator display; and
- it is possible in addition to actuate an ejection module for ejecting the defective boxes.

With the objects of the invention in view, there is also provided an alternative embodiment, in which the Braille dots are sprayed on or imprinted. In this case, the applied amount is varied instead of the embossing gap.

In accordance with another feature of the invention, the folder gluer has at least one further monitoring device for two-dimensional image inspection of the folding box. This embodiment has the advantage of also being able to detect on the folding boxes two-dimensional defects such as, for example, soiling, color deviations, register offset, material purity, etc. with the aid of the known monitoring modules, for example, through the use of a CCD camera.

In accordance with a further feature of the invention, the further monitoring device is fitted upstream and/or downstream of the Braille embossing monitoring device. Visual influences exerted on the printed image by the Braille embossment can also be detected in this way.

In accordance with an added feature of the invention, the monitoring devices are disposed below the transport device for the folding boxes. This ensures that the front side of the box is inspected, and thus that both the printed image and the height of the Braille dots are actually detected.

In accordance with an additional feature of the invention, a plurality of monitoring devices are disposed next to one another. This is valid both for the two-dimensional and for the topographic monitoring device. This has the advantage that it is possible to inspect the complete box. It is therefore also possible to inspect a plurality of Braille embossments disposed on the box at different positions, for example next to one another or offset one behind the other, individually and in one processing step.

The folder gluer can also be used as an offline monitoring module, for example for Braille applied in the blanking press, in which case the then superfluous processing stations would be omitted. Such an offline module would then have, for example, the following stations: feeder, aligning stations, monitoring device, Braille embossing monitoring device, ejection module.

With the objects of the invention in view, there is furthermore provided a method for controlling individual processing stations inside a folder gluer during the manufacture of folding boxes. The method comprises the following steps:

a) separating the folding boxes;
b) inspecting the folding boxes for defects;
c) aligning the folding boxes;
d) ejecting the defective boxes without further processing, or
e) applying Braille embossments;
f) monitoring the Braille embossments individually for at least position, height and volume;
g) ejecting defective boxes; and
h) outputting a control signal to a control device in order to adjust the embossing devices and/or the aligning device in the case of defective Braille embossments.

In accordance with an alternative concomitant mode of the invention, step h) is replaced by a display of the defects on an operator display.

In the device for monitoring sheet-like material in accordance with the present invention, the monitoring system is disposed above and/or below the transport device and includes a camera and a light source. The camera angle with reference to the surface to be monitored and/or the impingement angle of the beams from the light source onto the sheet-like material can be varied.

Other features which are considered as characteristic for the invention are set forth in the appended claims.

Although the invention is illustrated and described herein as embodied in a folder gluer or folding-box gluer and a method for controlling individual processing stations inside a folder gluer or folding-box gluer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
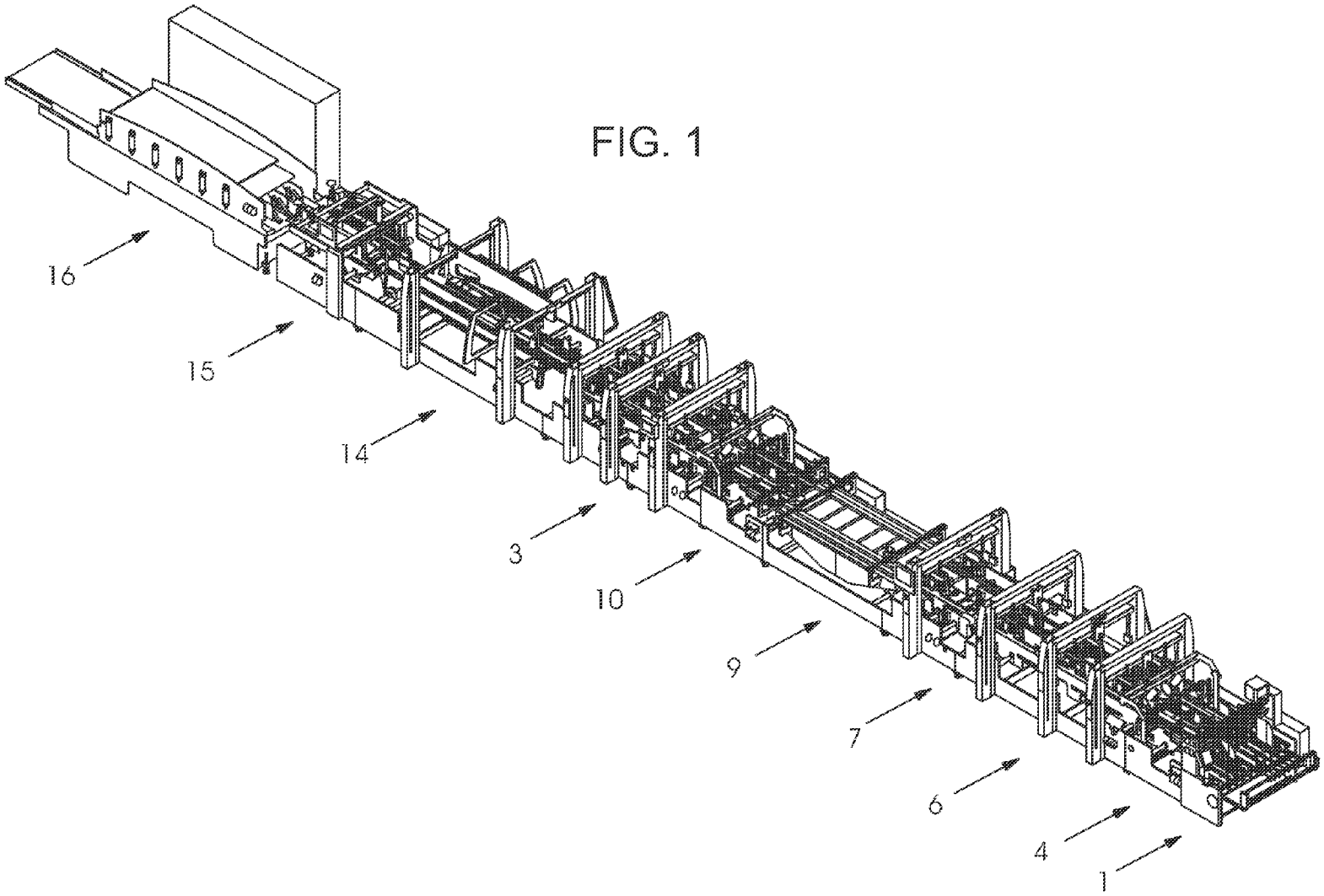
FIG. 1 is a diagrammatic, perspective view of an example of individual processing stations of a folder gluer.

Referring now to the figures of the drawings in detail and first, particularly, to FIG. 1 thereof, there are seen, by way of example, individual processing stations of a known folder gluer, noting that all of the folder gluers according to the exemplary embodiments include a plurality of processing stations through which box blanks run sequentially.

The folder gluer begins at the lower right of FIG. 1 with a feeder 1, which sequentially removes the blanks to be processed at high speed from a stack, and feeds them individually to a subsequent processing station. Following the feeder 1 is an aligning station 4 in which the blanks are aligned individually against a lateral stop. Transversely positionable machine components, which lead through the aligning station, are in the form of two pairs of belts that serve as conveying elements and can be transversely positioned through actuators.

A prebreaker or prefolder 6 and a first folding module 7 follow the aligning station 4. Transversely positionable machine components in the form of pairs of belts lead both through the prefolder 6 and through the folding module 7 as conveying elements that are transversely positioned as a function of the type of blank with the aid of an actuator.

A rotary station 9 follows the folding module 7. The rotary station 9 includes two conveyer sections that serve to rotate the blanks about a vertical axis by 90° and are disposed parallel next to one another, with it being possible to set the speed of the conveyor sections separately. The blanks rest on two conveyer sections in such a way that they are rotated in conjunction with different speeds of the two conveyer sections. The two conveyer sections include driven rollers as conveying elements.

Following the rotary station 9 is a further aligning station 10, having a structure which corresponds to the aligning station downstream of the feeder 1. It therefore includes, in turn, transversely positionable machine components in the form of pairs of conveyer belts as conveying elements.

The next processing station 13 serves the purpose of carrying out processing operations as a function of the type of box. For example, further crease lines may be prebroken or prefolded, or special folding operations may be carried out. Pairs of belts also lead through the processing station 13 as conveying elements that can be transversely positioned with the aid of actuators.

Blank parts previously provided with a glued seam are folded over by 180° in a folding station 14. The folding station 14 includes pairs of belts as conveying elements, and an adhesive application unit that can be moved through the use of actuators into the transverse position thereof as a function of the type of blank. A following transfer station 15 feeds the folded blanks, that are provided with glued seams which are not yet bonded, to a following collecting and pressing device 16 with all parts aligned exactly. An imbricated stream of folded blanks, which is initially formed in the collecting and pressing device 16, is subsequently held for some time under pressure between conveying pressing belts so that the glued seams bond. The transfer station likewise includes pairs of belts that can be transversely adjusted through the use of actuators.

Figure 2:
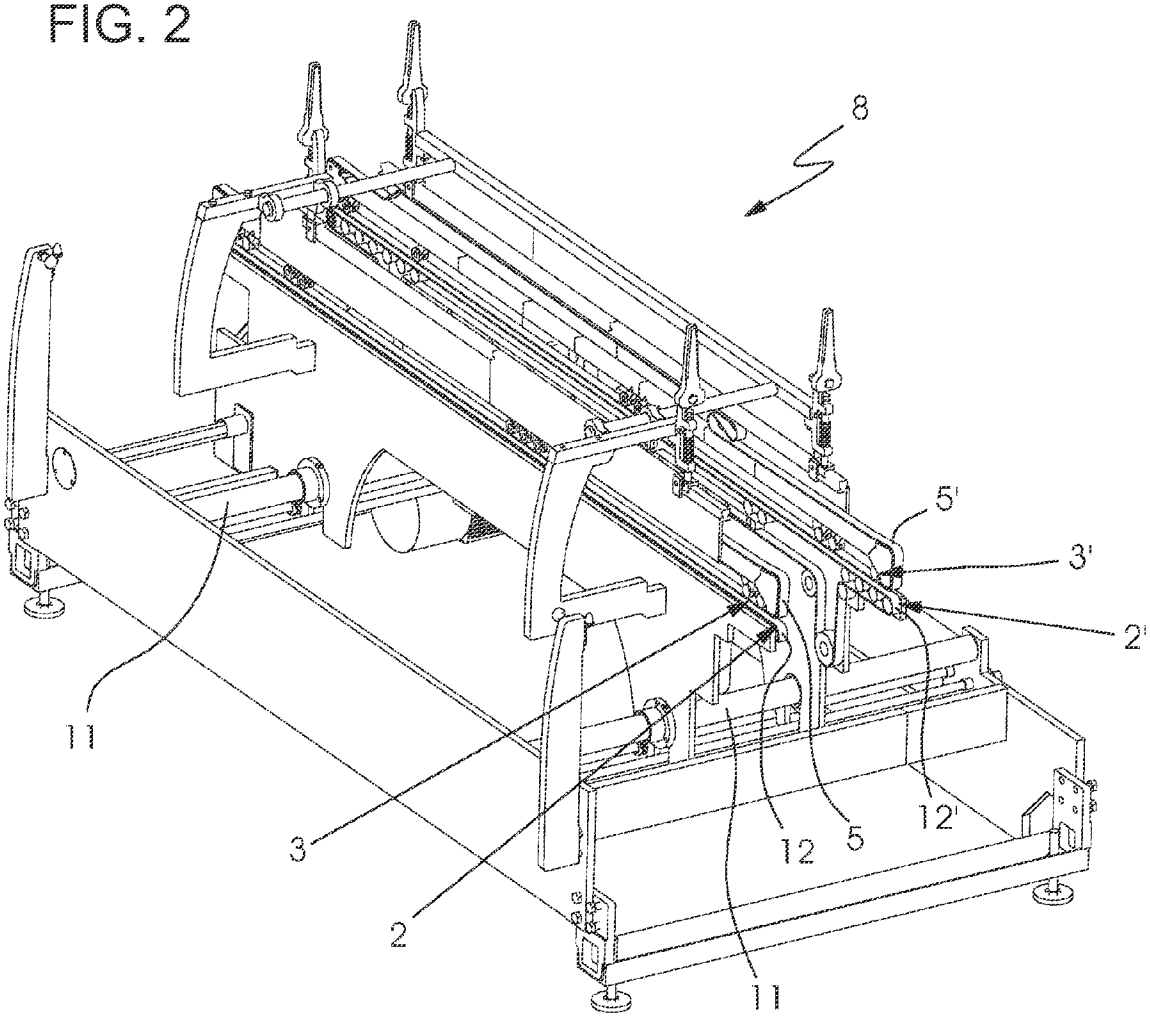
FIG. 2 is a perspective view of a continuous transport device according to the prior art in a processing station of a folder gluer.

FIG. 2 shows, by way of example, a transport device 8 having respective left-hand and right-hand upper conveying devices 3, 3' and respective left-hand and right-hand lower conveying devices 2, 2' and which is constructed in the present example as a belt conveyer with appropriate conveyer belts as conveying elements 5, 5', 12, 12'. The conveying devices 3, 3', 2, 2' are supported on round crossmembers 11 in such a way that they can be set to a respective box blank width.

Figure 3:
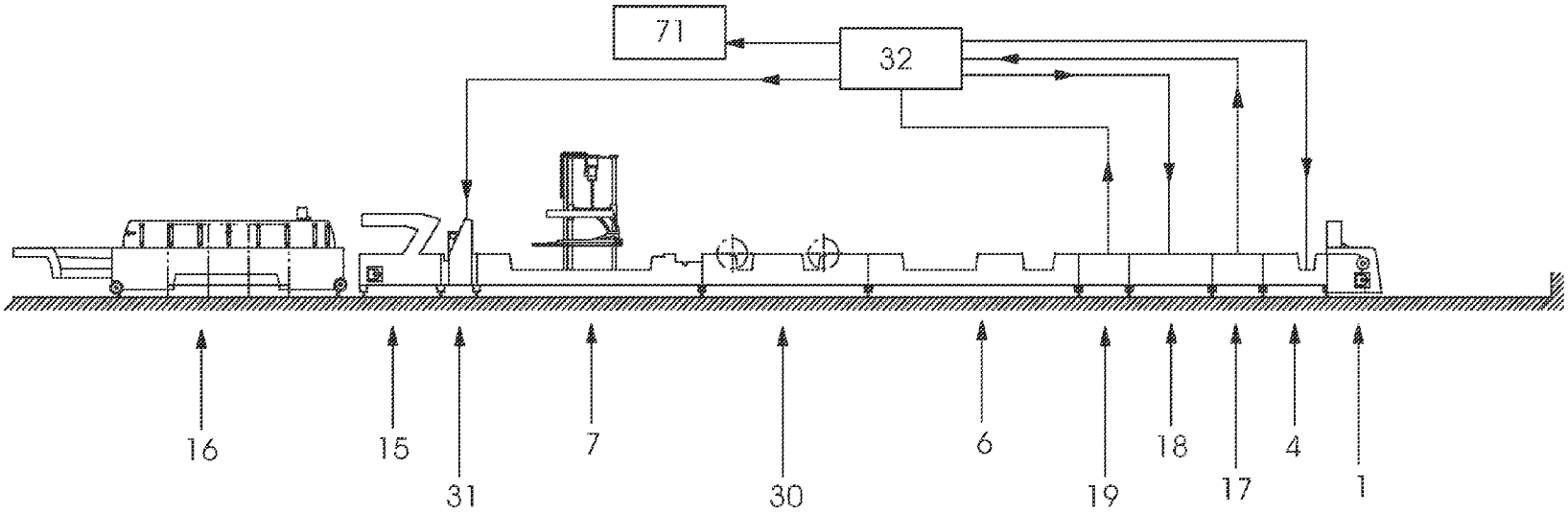
FIG. 3 is a longitudinal-sectional view of an example of individual processing stations with a Braille embossing device and various monitoring devices.

FIG. 3 shows a structure of a folder gluer according to the invention. The folder gluer has, by way of example, the following processing stations: a feeder 1, an aligning station 4, a monitoring device 17 for two-dimensional defect monitoring, a Braille embossing device 18 followed by a Braille embossing monitoring device 19, a prefolder or prebreaker 6, a box erecting station 30, a folding module 7, an ejection module 31, a transfer station 15 and a collecting and pressing device 16. The processing stations and their sequence are purely exemplary. The configuration and number of monitoring devices 17, 19 is likewise merely exemplary. The monitoring station 17 is connected to a controller 32 and supplies this controller with data relating to defective boxes. Depending on these data, the controller transmits signals to the ejection station 31 in order to eject the defective boxes. The Braille embossments are inspected for defects with regard to height, surface and volume, that is to say topographically, in the Braille embossing monitoring device 19. Furthermore, the position of the Braille embossment in relation to the box edge is analyzed, as are the completeness and correctness of the embossment. The data are then either put onto a display so that the operator can undertake the appropriate corrections manually, or they are passed on through the controller to the appropriate station for the purpose of automated adjustment or ejection.

For the sake of greater clarity, only one upper and one lower conveying device is respectively illustrated in the following figures.

Figure 4:
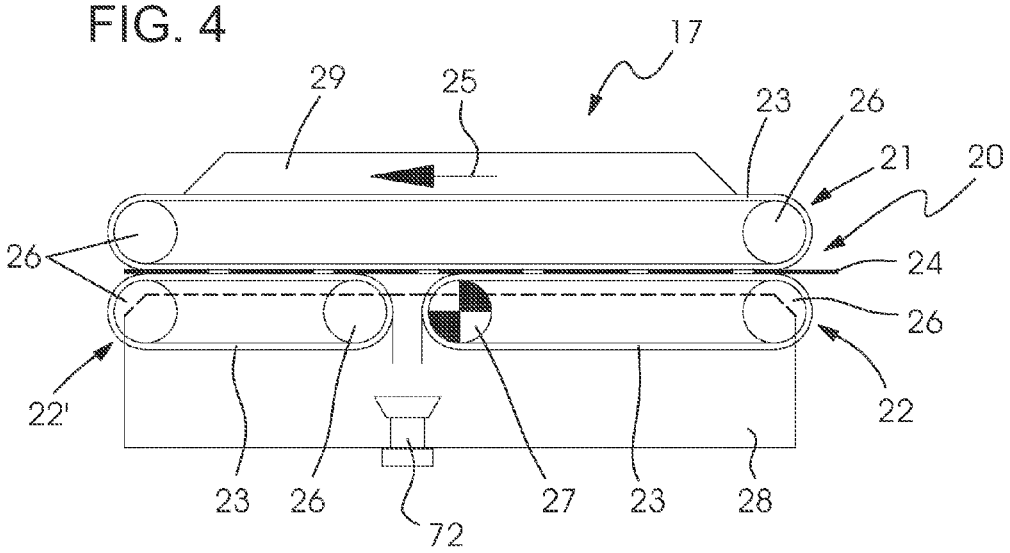
FIG. 4 is a side-elevational view of a monitoring device for two-dimensional defect testing.

FIG. 4 shows a monitoring device 17. Sheet-shaped material 24 such as, for example, folding-box blanks, that is to be monitored, is transported in a conveying direction 25 through the device 17 by a transport device 20. In the illustrated embodiment, the transport device 20 has an upper conveying device 21 with an endless conveying element 23 that is guided around deflecting rollers 26. Furthermore, first and second lower conveying devices 22, 22' are provided which form a gap relative to one another. The two lower conveying devices 22, 22' likewise have conveying elements 23 that are guided around deflecting rollers 26. The second deflecting roller 26, as seen in the conveying direction 25, of the first lower conveying device 22, as seen in the conveying direction 25, is connected to a drive, which is illustrated by triangular shading, and thus serves as a drive roller 27 for the conveying element 23 of the lower conveying device. The conveying elements 23 in the present exemplary embodiment are constructed as endless conveyer belts. The conveying elements 23 of the upper and lower conveying devices 21, 22, 22' touch or contact one another and clamp the sheets 24 to be transported between them. The upper conveying device is supported in a known way in a rolling rail 29, and the lower conveying devices are supported in roller sidepieces or cheeks 28. A monitoring system 72 is fitted below the sheet conveyer belt inside the gap between the lower conveying devices 22, 22' in such a way that the sheets transported through the gap can be tested from below through the use of the monitoring system 72. The monitoring system 72 has a camera and a light source. The camera and the light source are illustrated purely diagrammatically for greater clarity. They serve to detect two-dimensional defects on the folding box.

The monitoring system 72 according to the invention can, of course, also be formed into an inspection module with other transport devices 20.

Figure 5:
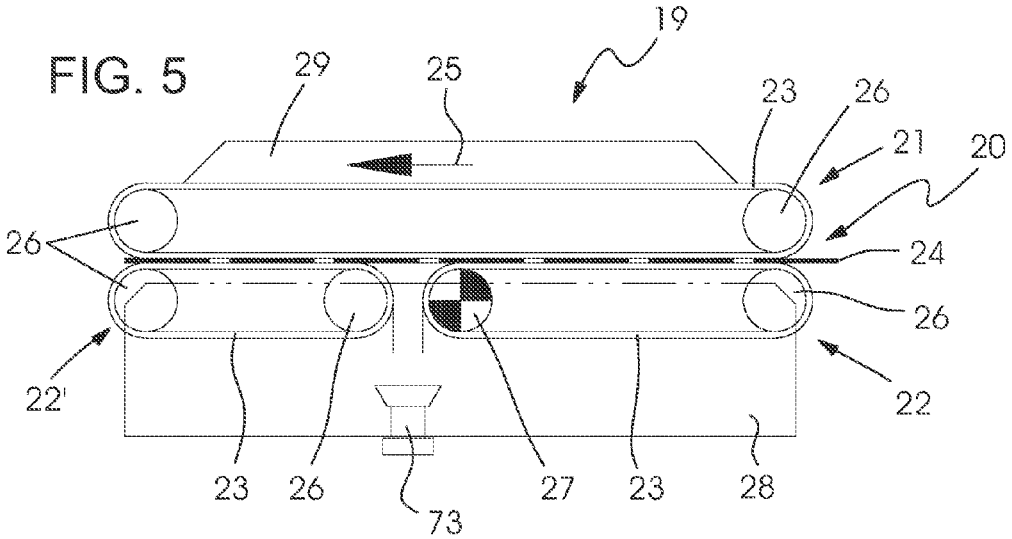
FIG. 5 is a side-elevational view of a Braille embossing monitoring device for topographic defect testing.

FIG. 5 shows a Braille embossing monitoring device 19. In the present exemplary embodiment, the structure thereof is the same as the structure of the monitoring device 17 of FIG. 4. The difference resides in the use of a 3D sensor 73 for topographic defect monitoring.

The 3D sensor 73 supplies signals regarding the following:

height, surface and volume of individual Braille dots;

position of the Braille embossment relative to a box edge; and testing whether or not all dots of the embossment are present and whether or not the correct embossment has been used.

The data are sent to the controller 32. Depending on this data, the controller 32 will:

Readjust the Braille embossing device 18 if the height or the volume of the individual Braille embossing dots lies outside a tolerance range, and additionally send a signal to the ejection module 31 in order to eject the defective box.

Readjust the aligning station and/or the embossing die if the position of the Braille embossing dots relative to the box edge lies outside the tolerance range, and additionally send a signal to the ejection module 31 in order to eject the defective box.

Send a defect report to the operator display if the false Braille embossment is used or there are individual Braille dot errors, and additionally send a signal to the ejection module 31 in order to eject the defective box.

Of course, all of the operations outlined can also be performed manually by the operator. In this case, the controller 32 would send appropriate instructions to the operator display.

Figure 6:
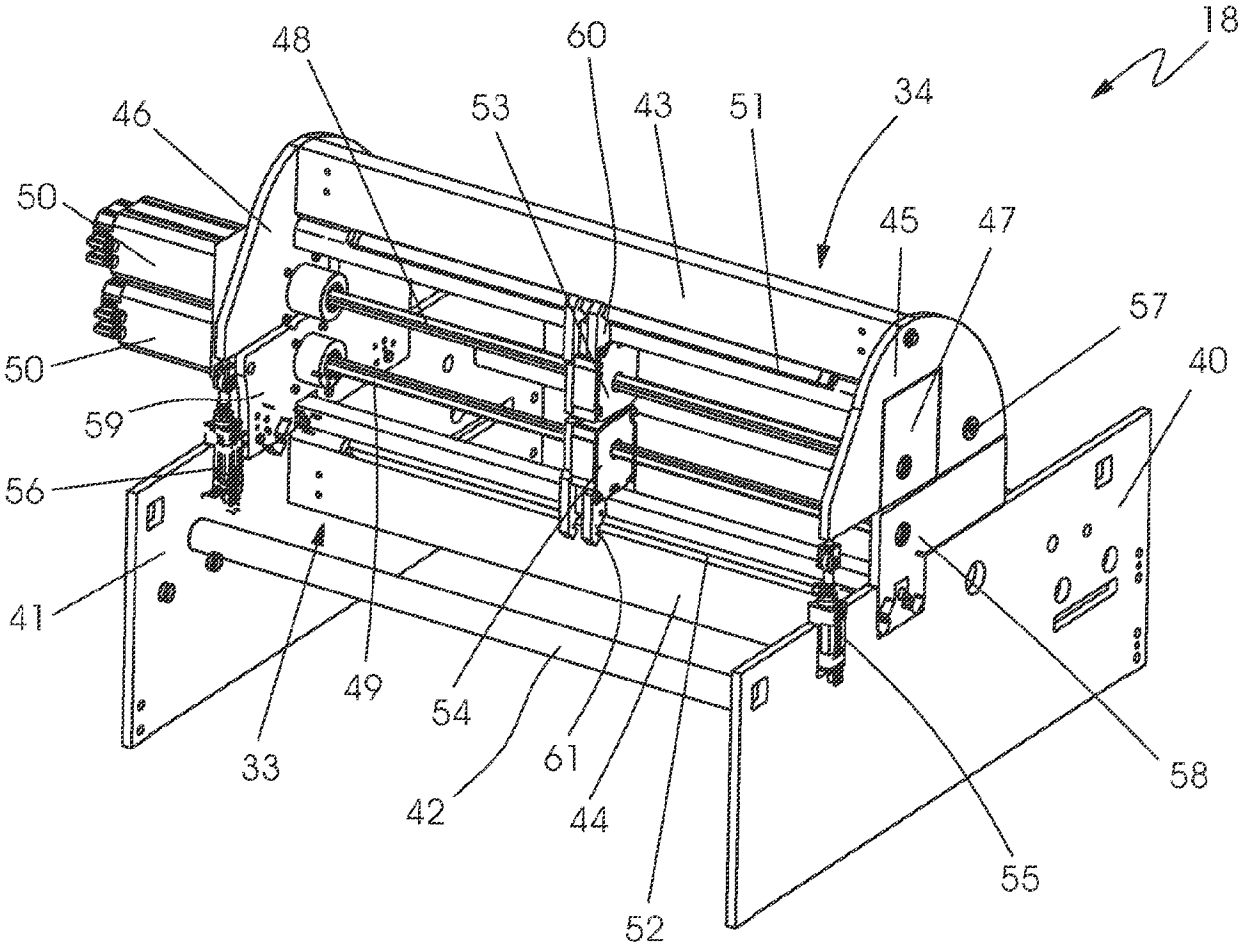
FIG. 6 is a perspective view of a Braille embossing device with a height adjusting device.

FIG. 6 shows an example of a Braille embossing device 18. The device 18 has a right-hand frame wall 40 and a left-hand frame wall 41 that are interconnected by crossmembers 42, one of which is illustrated in FIG. 6. A lower die holder 33 is permanently screwed onto the frame walls 40, 41. The lower die holder 33 has a lower crossmember 44 that is screwed between the frame walls 40, 41. Furthermore, a lower drive shaft 49 is supported between a left-hand lower side wall 59 and a right-hand lower side wall that is constructed as a removable bearing cover 58. The left-hand lower side wall 59 is fastened on the left-hand frame wall 41 and the lower bearing cover 58 is fastened on the right-hand frame wall 40. A lower die unit 54 is supported on the lower drive shaft 49 and is connected in a laterally sliding fashion to the lower drive shaft 49 through a lower die guide element 61 that is supported on the lower crossmember 44. The lower die unit can be fixed at any desired site between the two lower side walls 58, 59 with the aid of a pneumatic lower clamping element 52.

An upper die holder 34 is fastened above the lower die holder 33. The upper die holder 34 is fastened pivotably about an axis of rotation 57 fixed to the frame. The upper die holder 34 has an upper transverse cross member 43 and an upper drive shaft 48 which are both supported or fastened between a left-hand upper side wall 46 and a right-hand upper side wall 45. The right-hand upper side wall has a removable upper bearing cover 47 for supporting the drive shaft 48. An upper die unit 53 is supported on the upper drive shaft 48 and is connected in a laterally sliding fashion to the upper drive shaft 48 through an upper die guide element 60 that is supported on the upper crossmember 43. The upper die unit 53 can be fixed at any desired site between the two upper side walls 45, 46 with the aid of an upper pneumatic clamping element 51. The two drive shafts 48, 49 are respectively driven by separate servomotors 50. The pivoting movement of the upper die holder 34 about the axis of rotation 57 which is fixed to the frame is advantageous for the purpose of eliminating double feeds and in the case of a change of dies. The mutual spacing of the two die holders 33, 34 can be varied through two pneumatic cylinders 55, 56. The latter are supported, on one hand on the frame walls 40, 41 and, on the other hand on the upper side walls 45, 46. It is thus possible to make a targeted setting of the action of the die units 53, 54 on the sheet-like material 24 to be processed, which is to be transported through between the two die units 53, 54. In particular, it is easily possible to thereby change over to various material thicknesses. The pneumatic cylinders 55, 56 are connected to the controller 32 that regulates the pneumatic cylinders 55, 56 as a function of the signals of the Braille embossing monitoring device 19.

Figure 7:
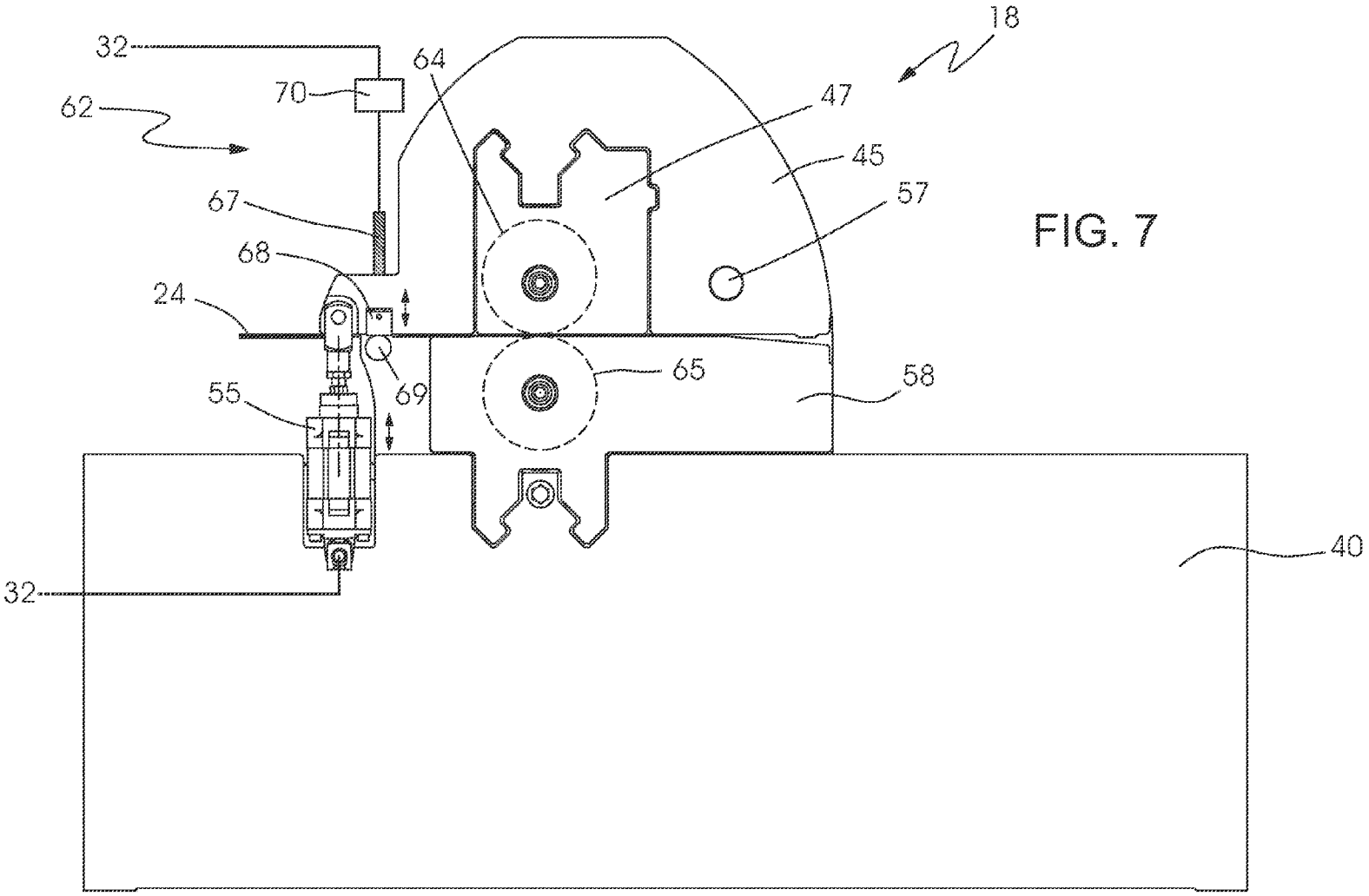
FIG. 7 is an enlarged, side-elevational view of a Braille embossing device with additional fine height adjustment.

FIG. 7 shows the device 18 in a side view with an additional fine setting device 62. As already described, the spacing of the two die holders 33, 34 and thus also the spacing of Braille embossing dies 64, 65, can be set through the pneumatic cylinders 55, 56 by pivoting the upper die holder 34 about the axis of rotation 57 fixed to the frame. When Braille symbols are being embossed in folding boxes, it is advantageous for an additional fine setting of the mutual spacing of the embossing dies to be possible. It is thereby possible, on one hand, to set the embossing dies more accurately to the cardboard thickness, but on the other hand it is also possible to exert a positive influence on the embossing depth in the cardboard, and thus on the clean-cut formation of the Braille symbols. It is desirable in this case to have a possibility of setting down to a range of 100ths of a millimeter. In the case of the present embodiment, this fine setting is implemented by virtue of the fact that the fine setting device 62 has two stops 68, 69, and the stop 69 is fixed while the stop 68 can be set to the desired spacing through an adjusting motor 70, a threaded spindle 67 and a non-illustrated worm gear. Just like the pneumatic cylinders 55, 56, the adjusting motor 70 is connected to the controller 32 that regulates the pneumatic cylinders 44, 46 and the adjusting motor 70 as a function of the signals of the Braille embossing monitoring device. The pneumatic cylinders 55, 56 and the threaded spindle 67 are merely exemplary features in the present exemplary embodiments. It is likewise possible to conceive of other actuators that can be regulated by the controller 32. In addition, the Braille embossing device can have a non-illustrated adjusting device for the male die and female die. This enables use of the controller 32 to adjust the Braille dies relative to the blank if the Braille embossment lies outside the tolerance with regard to its distance from the box edge.

It is also possible, furthermore, to replace the adjusting motor 70 with a mechanical adjusting device that is adjusted by the operator. In this case, the controller would send the data to a display. The operator could then undertake the adjustment that might be necessary depending on these data.

The invention claimed is:

1. A folder gluer, comprising:

a Braille embossing device disposed inside the folder gluer and having a male die and a female die;

at least one monitoring device for checking qualitative aspects during folding-box manufacture, said at least one monitoring device including an optical Braille embossing monitoring device disposed downstream of said Braille embossing device for evaluating Braille embossments at least with regard to position, height and volume and supplying signals; and a control device connected to and receiving the signals supplied by said optical Braille embossing monitoring device, said control device, based on the signals supplied by said optical Braille embossing monitoring device, controlling at least one of:

a distance between said male and female dies; or a mutual position of said male and female dies.

2. The folder gluer according to claim 1, which further comprises at least one further monitoring device disposed inside the folder gluer for two-dimensional image inspection of the folding box.

3. The folder gluer according to claim 2, wherein said further monitoring device is disposed at least one of upstream or downstream of said optical Braille embossing monitoring device, inside the folder gluer.

4. The folder gluer according to claim 2, which further comprises a transport device for folding boxes, said monitoring devices being disposed below said transport device.

5. The folder gluer according to claim 1, wherein said optical Braille monitoring device is one of a plurality of monitoring devices disposed next to one another.

6. A folder gluer, comprising:

a Braille application device disposed inside the folder gluer and imprinting or spraying on Braille dots;

at least one monitoring device for checking qualitative aspects during folding-box manufacture, said at least one monitoring device including an optical Braille monitoring device disposed downstream of said Braille application device for evaluating the Braille dots at least with regard to position, height and volume and supplying signals; and a control device connected to and receiving the signals supplied by said optical Braille monitoring device, said control device, based on the signals supplied by said optical Braille embossing monitoring device, controlling an applied amount for spraying on or imprinting the Braille dots.

7. The folder gluer according to claim 6, which further comprises at least one further monitoring device disposed inside the folder gluer for two-dimensional image inspection of the folding box.

8. The folder gluer according to claim 7, wherein said further monitoring device is disposed at least one of upstream or downstream of said optical Braille embossing monitoring device, inside the folder gluer.

9. The folder gluer according to claim 7, which further comprises a transport device for folding boxes, said monitoring devices being disposed below said transport device.

10. The folder gluer according to claim 6, wherein said optical Braille monitoring device is one of a plurality of monitoring devices disposed next to one another.

* * * * *